United States Patent [19]

Hurley

[11] 4,027,875

[45] June 7, 1977

[54] RECATION SPEED TRAINING DEVICE

[76] Inventor: Carson Monroe Hurley, P.O. Box 12783, Roanoke, Va. 24028

[22] Filed: Apr. 23, 1975

[21] Appl. No.: 570,616

[52] U.S. Cl. ..... 272/76

[51] Int. Cl.[2] ..... A63B 69/00

[58] Field of Search ..... 272/76, 77, 57 R, 59 A; 73/167, 11, 17, 13, 379, 380; 273/181 R, 181 J, 183 R, 102 A, 102.1 C, 102.2 R, 102.2 S, 183 R; 35/25

[56] References Cited

UNITED STATES PATENTS

| | | | |
|---|---|---|---|
| 232,424 | 9/1880 | Ullman | 273/102.2 R |
| 3,363,243 | 1/1968 | Morley | 272/59 A |
| 3,434,712 | 3/1969 | Matsumura et al. | 272/59 A |

*Primary Examiner*—Richard C. Pinkham
*Assistant Examiner*—T. Brown

[57] ABSTRACT

This device is primarily a pair of spaced apart, electrically connected stands, each being provided with electrical circuitry switch boxes. Each of the switch boxes is provided with an external plunger; the plunger being connected to the electrical circuitry and acting as a switch. A timer is connected to the electrical circuitry connecting the plungers such that the time elapse required for a person to activate the timer by touching the plunger on one switch box and stop the timer by touching the plunger on the other switch box will be recorded.

1 Claim, 4 Drawing Figures

RECATION SPEED TRAINING DEVICE

This invention relates to timer devices and more particularly to a reaction training device.

It is, therefore, the principal object of this invention to provide a reaction speed trainer device which will measure and record elapsed time from one given point to another, the device being particularly useful in karate so as to record the time in throwing a punch and also reaction speed.

Another object of this invention is to provide a reaction speed training device which will be operated by the student or students.

Still another object of this invention is to provide a training device of the type described which will have switch means to start the counter and when the student strikes the plunger, the plunger will drive a pin into a micro-switch stopping the current to the counter, thereby recording the elapse time it took the hand or foot to move from one point to another.

Other objects of the invention are to provide a reaction speed training device which is simple in design, inexpensive to manufacture, rugged in construction, easy to use and efficient in operation.

These and other objects will become readily evident upon a study of the following specification and the accompanying drawing wherein.

Figure 1:
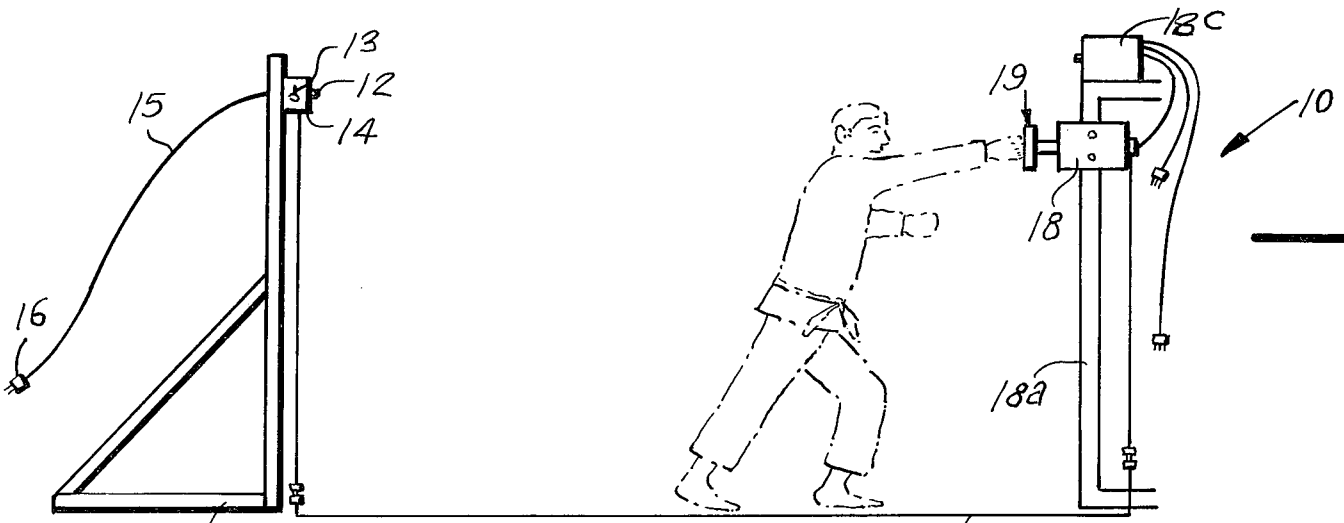
FIG. 1 is a diagrammatic side view of the present invention shown in elevation.

According to this invention, a training device 10 is shown to include a stand 11 to which is mounted a switch 12 and a switch 13 in box 14 which is connected by electric cord 15 having a plug 16 for being received within an electrical outlet. Box 14 connects by wire 17 to housing 18 which is elevatable in a suitable manner upon stand 18*a*. A plunger 19 of housing 18 is shown to include a rubber pad 19*a* which is fixedly secured in a suitable manner to a wooden block 21 which is secured fixedly in a suitable manner to plate 22 terminating one end of sleeve 23. Sleeve 23 is slideably received within bushing 24 secured fixedly within housing 18, the end of sleeve 23 being secured fixedly to an extending pin 23*a*. A pin 25 encompases spring 23*a* and urges against the end of sleeve 23 at one end and urges against end wall 18*b* of housing 18 at the opposite end. A housing 18*c* is secured fixedly to the upper portion of stand 18*a* and is provided with a counter 18*d* therein, an imitator light 18*e*.

In use, the student stands with his arm against stand 11 with his elbow pushing in switch 12 keeping switch 12 depressed, he then flips switch 13 to the on position. When the punches towards plunger 19, the current is on and the counter 18*d* in box 18*c* will start. When the student strikes the plunger 19, this drives the plunger pin 23*a* into micro-switch 26, which stops the current to counter 18*d* thereby recording the elapsed time it took his hand or foot to move from switch 12 to plunger 19.

Figure 2:
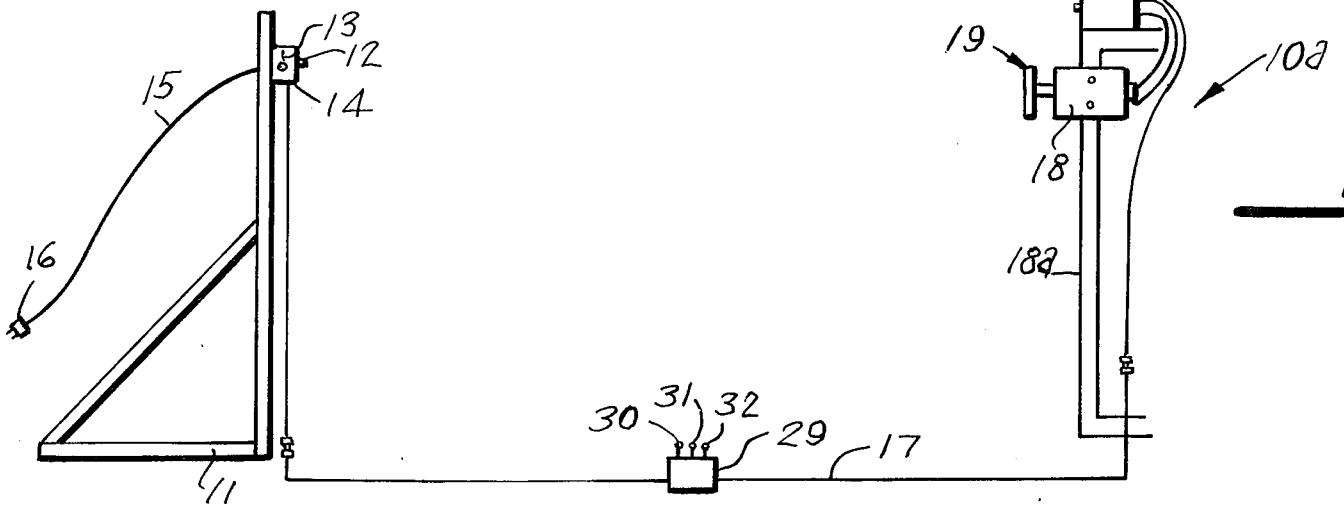
FIG. 2 is similar to FIG. 1 but shows a modified form of the invention.
Figure 3:
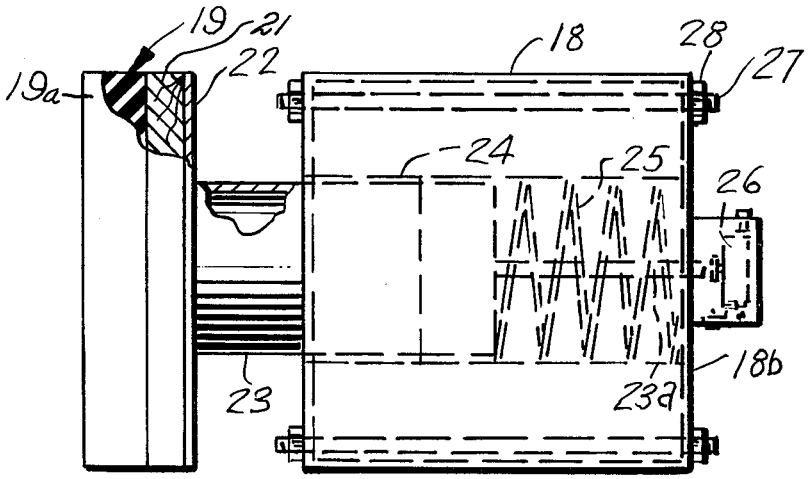
FIG. 3 is an enlarged side view of the spring-loaded plunger box shown in elevation, partly broken away and removed from the invention.
Figure 4:
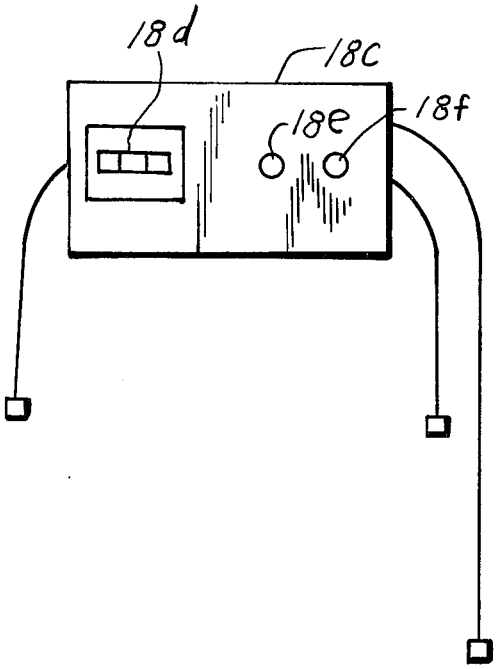
FIG. 4 is a front view of the counter box shown in elevation and removed from the invention.

Referring now more particularly to FIG. 2 of the drawing, the modified form 10*a* is shown to include an on and off switch box 29 having switches 30, 31, and 32. The on and off switch box 29 is connected within the wire 17. The form 10*a* for recording the action time, is the same as heretofore described for form 10, except another student operates the switches 30, 31 and 32 in box 29. The switches 30, 31 and 32 of box 29 are push-type switches, one of which controls a red light 18*e* of box 18*c* and another of the switches controls the green light 18*f* and the third resets or cuts off the lights 18*e* and 18*f*. When the red light 18*e* is on, the student throwing the punches or kicking is on standby or ready position. When the green light 18*f* cuts on, it starts the counter 18*d* and the student must punch the plunger 19 in order to stop the counter 18*d*.

What I now claim is:

1. A reaction-speed training device comprising first and second spaced apart substantially vertical support stands, said first stand having secured thereto a first electrical switch box having a first user actuated contact switch connected thereto; said second stand having secured thereto a second electrical switch box and a second user actuated contact switch connected thereto; timing means; said timing means being electrically connected to each of said user actuated contact switches such that said timer will be started when said first user actuated contact switch is actuated by a user and will be stopped when said second user actuated contact switch is actuated by the same said user to thereby indicate the time elapse between actuation of said first and second contact switches by said user; said second switch box having an elongated, spring biased substantially horizontally extending plunger mounted thereon, said second contact switch being mounted adjacent one end of said plunger such that said one end will engage said switch when said plunger is moved in the direction thereof, said plunger having mounted on its opposite end an enlarged resilient target pad for striking by a user to move said plunger one end into contact with said second switch.

* * * * *